US009889687B2

(12) United States Patent
Watanabe et al.

(10) Patent No.: US 9,889,687 B2
(45) Date of Patent: Feb. 13, 2018

(54) PRINTER

(71) Applicant: Seiko Epson Corporation, Tokyo (JP)

(72) Inventors: Yuta Watanabe, Matsumoto (JP); Kazuma Ozaki, Okaya (JP); Hidenobu Ota, Hara-Mura (JP); Takao Yamamoto, Shiojiri (JP); Akira Ishikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/293,637

(22) Filed: Oct. 14, 2016

(65) Prior Publication Data

US 2017/0106683 A1 Apr. 20, 2017

(30) Foreign Application Priority Data

Oct. 19, 2015 (JP) ..... 2015-205855

(51) Int. Cl.
*B41J 15/16* (2006.01)
*B65H 31/02* (2006.01)
*B65H 31/22* (2006.01)

(52) U.S. Cl.
CPC ..... *B41J 15/16* (2013.01); *B65H 31/02* (2013.01); *B65H 31/22* (2013.01); *B65H 2402/344* (2013.01); *B65H 2701/11312* (2013.01); *B65H 2801/12* (2013.01); *B65H 2801/36* (2013.01)

(58) Field of Classification Search
CPC ..... B41J 15/16; B65H 31/02; B65H 31/22; B65H 2801/36; B65H 2701/11312; B65H 2801/12; B65H 2402/344
See application file for complete search history.

(56) References Cited

U.S. PATENT DOCUMENTS 5,012,295 A * 4/1991 Ikkatai ..... B41J 13/106 271/207
6,568,865 B1 * 5/2003 Fujioka ..... B65H 31/02 271/207
8,622,385 B2 * 1/2014 Ueyama ..... B65H 31/20 271/207
2008/0252948 A1 * 10/2008 Onishi ..... H04N 1/6033 358/504
2010/0111584 A1 * 5/2010 Shiohara ..... B41J 13/106 399/405
2011/0024975 A1 2/2011 Saito et al.
2011/0249067 A1 * 10/2011 Izawa ..... B41J 3/60 347/102

FOREIGN PATENT DOCUMENTS

JP 2011-032045 A 2/2011

* cited by examiner

*Primary Examiner* — Henok Legesse
(74) *Attorney, Agent, or Firm* — Workman Nydegger

(57) ABSTRACT

A printer includes a printing unit that performs printing on a printing medium; a winding unit that winds the printing medium on which the printing is performed by the printing unit; and a frame unit which is positioned between the printing unit and the winding unit on a feeding path of the printing medium, in which in a case where the printing medium is not wound by the winding unit, a receiving member for receiving the printing medium is detachably mounted to the frame unit, and in a case where the printing medium is wound by the winding unit, the receiving member is detached such that the frame unit comes in contact with the printing medium.

10 Claims, 14 Drawing Sheets

100
1
121
122
1222
1221
126
12
1252
1251
125
124
123
Pa, P
141, 14
131
1411
1413
1412
112
13
132
113
1524
1523
111
1514
1513
1511
1512
2
1521
1522
11
114
151
152
15
+Z
-X
-Y
+Y
-Z 100A
1
121
122
1222
1221
126
12
1252
1251
125
124
123
Pa, P
1411
1412
1413
141, 14
112
113
1524
111
1523
1514
1513
1511
1512
1514
2
1522
1521
11
114
151
152
15
+Z
-X
-Y
+Y
-Z

PRINTER

BACKGROUND

1. Technical Field

The present invention relates to a printer on which a receiving member for receiving a printing medium is mounted.

In the related art, an ink jet printer including a stacker for receiving a recording sheet which is discharged from a discharging portion has been known (refer to JP-A-2011-032045).

The ink jet printer in the related art does not perform both of receiving a recording sheet by using a stacker, and winding the recording sheet. For this reason, it is not considered that the stacker is utilized in a case where the recording sheet is wound.

An advantage of some aspects of the invention is to provide a printer which is capable of efficiently using a frame unit on which a receiving member is mounted in a case where a printing medium is wound.

SUMMARY

According to the invention, there is provided a printer including a printing unit that performs printing on a printing medium; a winding unit that winds the printing medium on which the printing is performed by the printing unit; and a frame unit which is positioned between the printing unit and the winding unit on a feeding path of the printing medium, in which in a case where the printing medium is not wound by the winding unit, a receiving member for receiving the printing medium is detachably mounted to the frame unit, and in a case where the printing medium is wound by the winding unit, the receiving member is detached such that the frame unit comes in contact with the printing medium.

With such a configuration, in the case where the printing medium is not wound, the receiving member is mounted to the frame unit, and in the case where the printing medium is wound, the frame unit comes in contact with the printing medium so as to guide feeding of the printing medium. Therefore, according to this configuration, the frame unit on which the receiving member is mounted can be efficiently used in a case where the printing medium is wound.

In this case, it is preferable that the winding unit comes in contact with the printing medium such that a part of the printing medium before being wound by the winding unit is curved to the side opposite to the winding unit.

With such a configuration, it is possible to prevent the part of the printing medium which is wound by the winding unit from rubbing against the part of the printing medium before being wound by the winding unit.

In this case, it is preferable that the frame unit includes an engaging portion which is engaged with the receiving member.

With such a configuration, it is possible to preferably attach the receiving member to the frame unit by using the engaging portion.

In this case, it is preferable that a plurality of the engaging portions are provided along a width direction of the printing medium.

With such a configuration, loads can be dispersed into the plurality of engaging portions, and thus it is possible to disperse the loads applied to the frame unit.

In this case, it is preferable that the receiving member is attached to the frame unit so as to be wound, and in the winding direction of the receiving member, the engaging portion is provided on the downstream side in the winding direction further than a position at a half circumference from a winding start position.

With such a configuration, the engaging portion is not provided on the upstream side in the winding direction further than the position at a half circumference from the winding start position. For this reason, even in a case where the printed part received in the receiving member covers the upstream side in the winding direction further than the position at a half circumference from the winding start position, the printed part does not come in contact with the engaging portion. Therefore, according to this configuration, it is possible to prevent a printed surface of the printed part from being scratched in a case where the printed part comes in contact with the engaging portion.

In this case, it is preferable that a position where the frame unit is disposed in the case where the printing medium is not wound by the winding unit is the same as a position where the frame unit is disposed in the case where the printing medium is wound by the winding unit.

With such a configuration, it is possible to easily switch the case where the receiving member is used into a case where the receiving member is not used, without causing the frame unit to be movable.

In this case, it is preferable that the printer further includes a detecting unit which is capable of detecting that a slack amount of the printing medium wound by the winding unit approaches a predetermined amount, and the detecting unit is capable of being displaced between a detecting position where the slack amount that approaches a predetermined amount is detected, and a retractable position which is retracted from the detecting position.

With such a configuration, it is possible to detect that the slack amount of the printing medium approaches a predetermined amount, and thus it is possible to prevent the printing medium from being excessively slackened. In addition, the detecting unit is displaced to the retractable position, and thus in a case where the detecting unit is not used, it is possible to secure a space in the vicinity of a feeding path of the printing medium.

In this case, it is preferable that the detecting unit includes a first detecting unit and a second detecting unit, and at least one of the first detecting unit and the second detecting unit is rotated so as to be displaced between the detecting position and the retractable position.

With such a configuration, it is possible to easily displace at least one of the first detecting unit and the second detecting unit without replacing components.

In this case, it is preferable that the detecting unit is detachable from the winding unit.

With such a configuration, it is possible to use the winding unit and the detecting unit as a pair by mounting the detecting unit to the winding unit. For this reason, it is possible to easily store the detecting unit, or to prevent the detecting unit from being lost.

DESCRIPTION OF EXEMPLARY EMBODIMENTS

Figure 1:
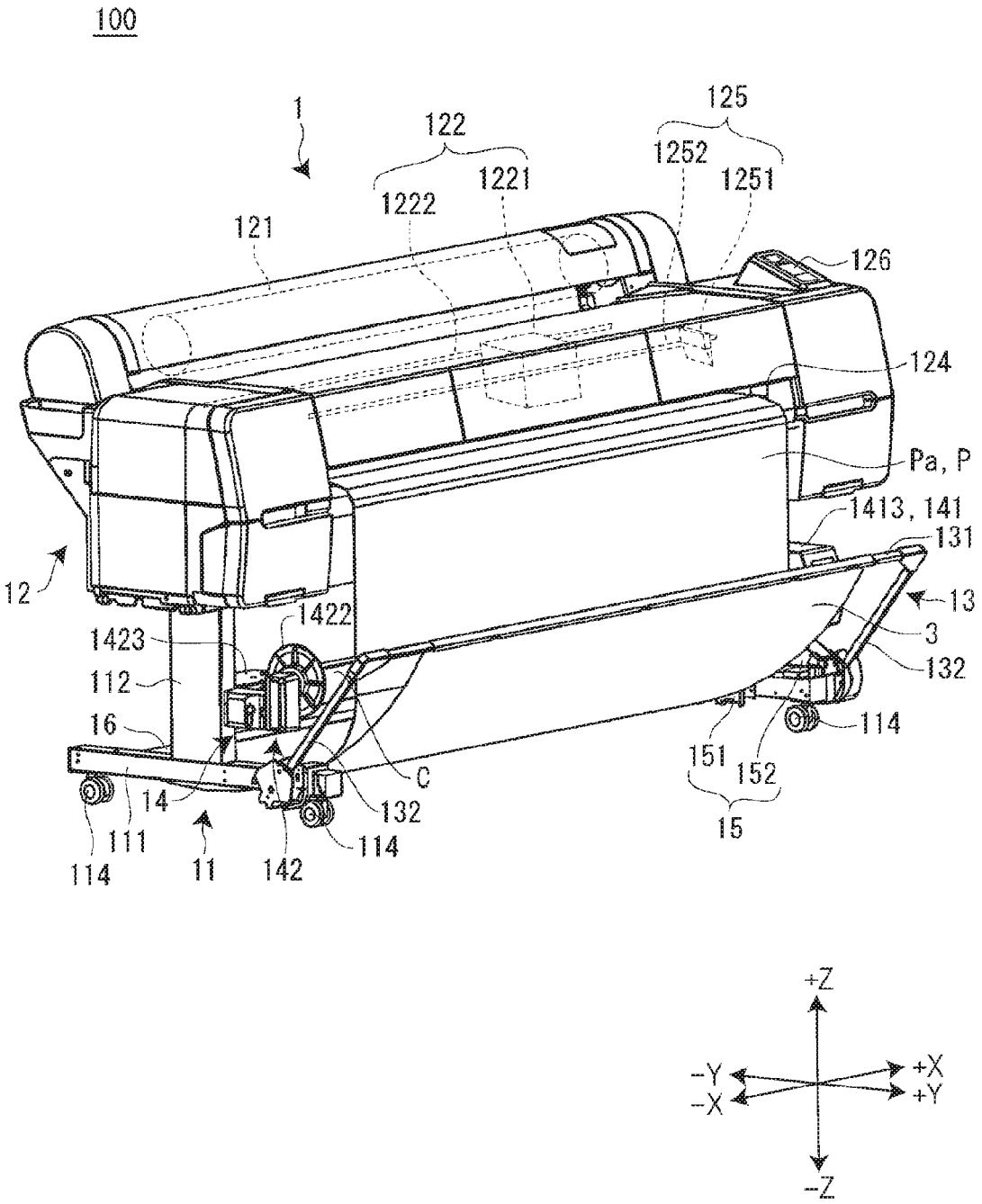
FIG. 1 is a perspective view of a printer (a receiving member mode) according to one embodiment of the invention.
Figure 2:
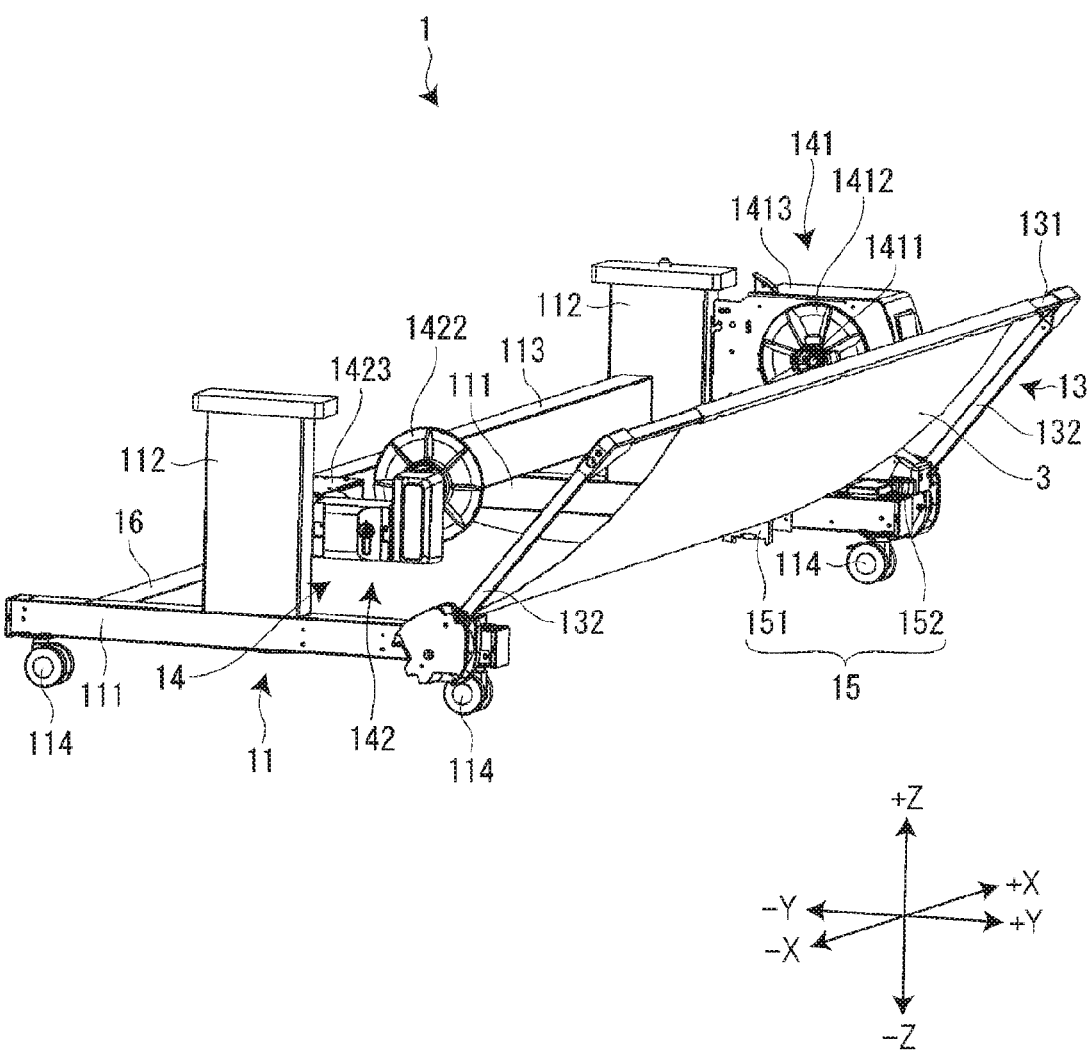
FIG. 2 is a perspective view of the printer (the receiving member mode) not including a housing portion.
Figure 3:
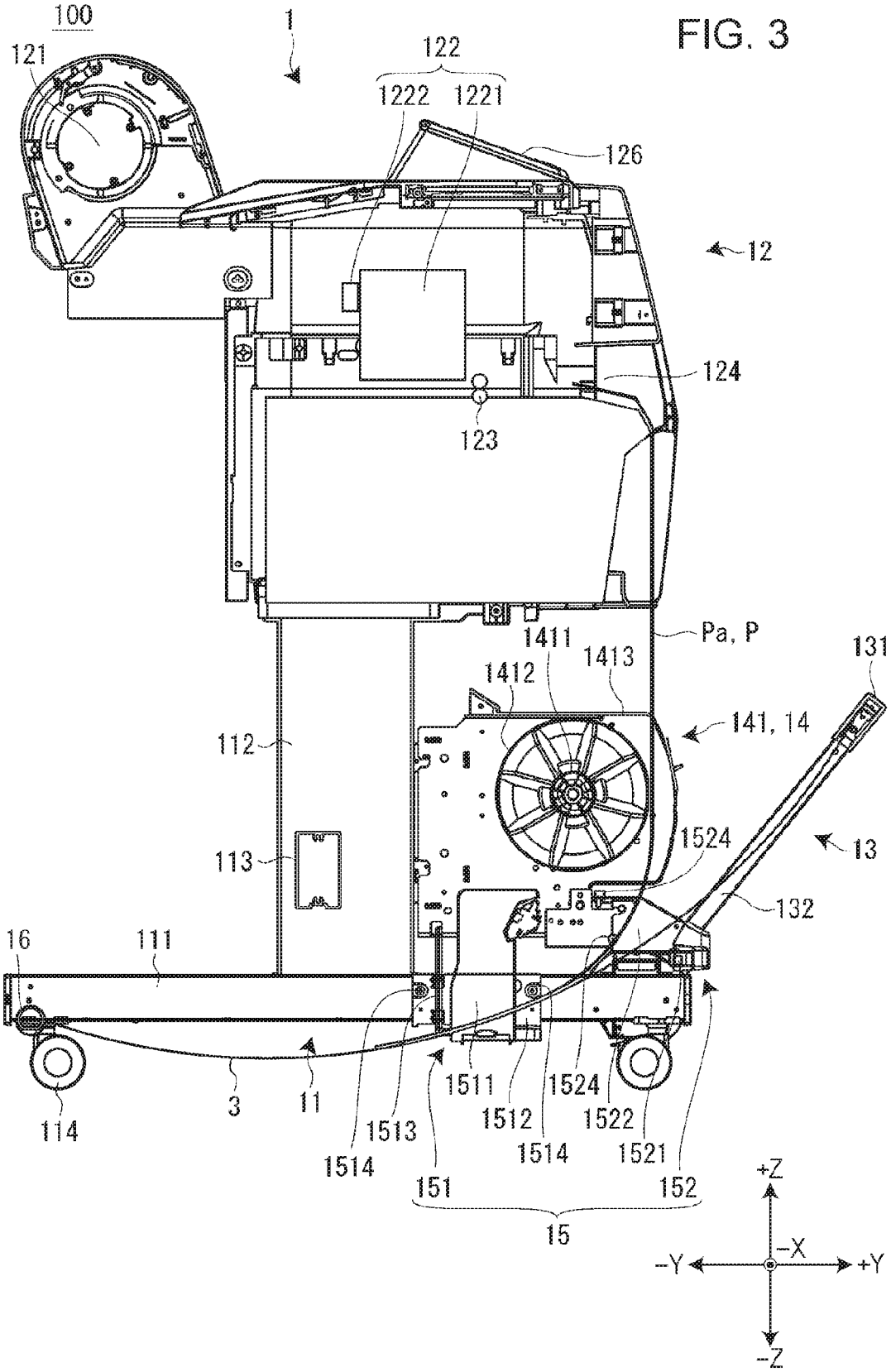
FIG. 3 is a sectional view of the printer (the receiving member mode).
Figure 4:
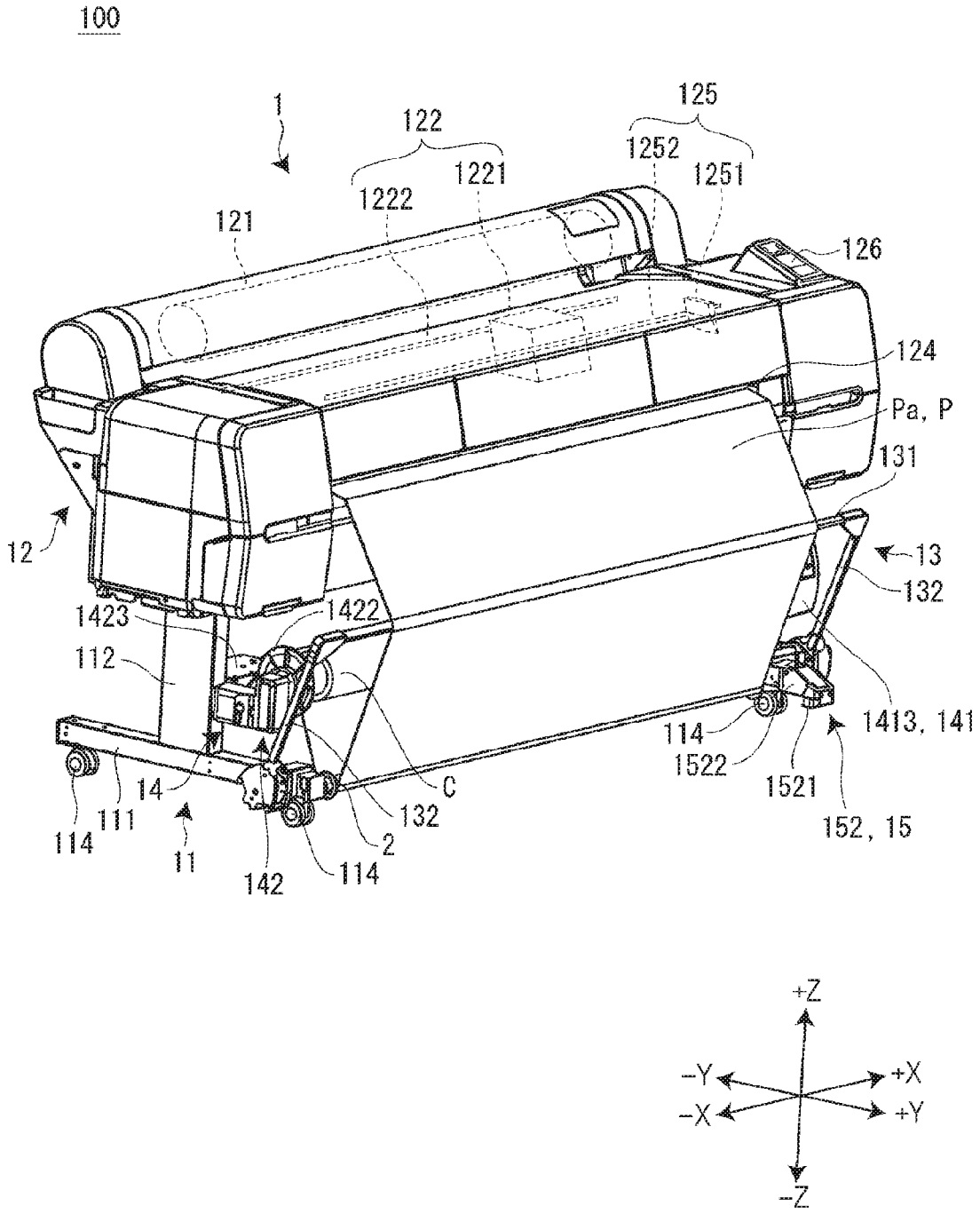
FIG. 4 is a perspective view of a printer (a winding mode).
Figure 5:
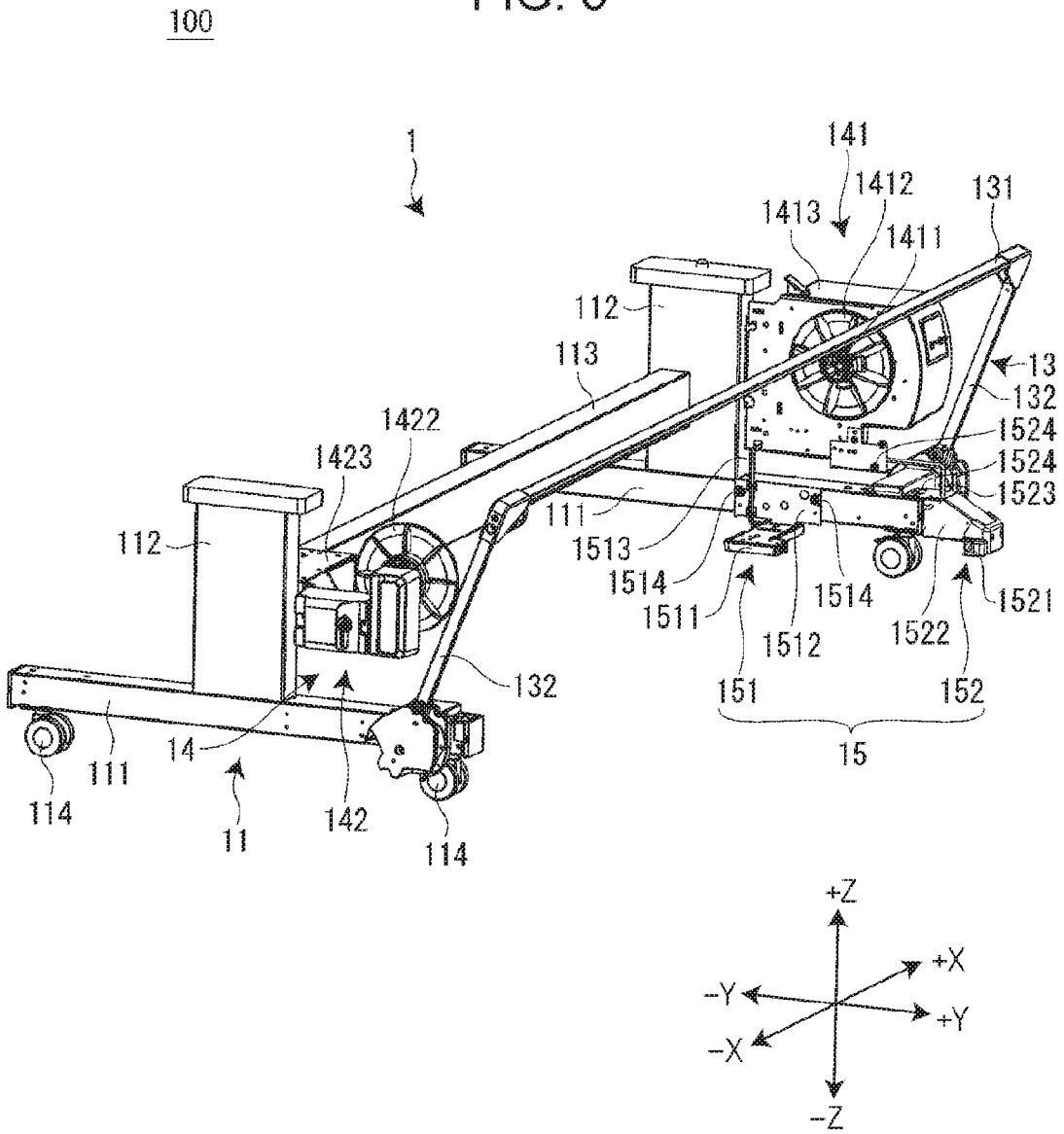
FIG. 5 is a perspective view of the printer (the winding mode) not including the housing portion.

Hereinafter, a printer 100 according to one embodiment of the invention will be described with reference to the attached drawings. The printer 100 includes a receiving member mode and a winding mode. In the receiving member mode of the printer 100, a printed part Pa of a printing medium P which is a continuous sheet is cut off by a cutting portion 125, and the cut-off printed part Pa is discharged to a sheet-like receiving member 3. Here, the receiving member mode may be used when the printing is performed by using a cut medium. In such a case, the printing medium P is originally a cut medium, and thus the cutting by the cutting portion 125 is not performed, and the printed cut medium is discharged to the receiving member 3. In the winding mode of the printer 100, the printed part Pa is wound without cutting off the printed part Pa. Note that, an X-Y-Z orthogonal coordinate system is indicated in the following drawings in order to make disposing relations between respective portions of the printer clear as necessary.

A configuration of the printer 100 will be described with reference to FIG. 1 to FIG. 6. The printer 100 is provided with an apparatus main body 1, weight equipment 2, and a receiving member 3. The apparatus main body 1 is provided with a leg portion 11, a housing portion 12, a first receiving member mounting portion 13, a second receiving member mounting portion 16, a winding unit 14, and a slack detecting sensor 15. The slack detecting sensor 15 is an example of a detecting unit for detects a slack amount of the printing medium P.

The leg portion 11 supports the housing portion 12 and the like. The leg portion 11 is formed of metallic extruding materials in combination. The leg portion 11 is provided with two base portions 111, two pillar portions 112, and a beam 113. Two of the base portions 111 are arranged in the X direction. The base portion 111 is provided such that the longitudinal direction is set to be the Y direction. A caster 114 is provided at each of both end portions of the base portion 111 in the Y direction. The pillar portions 112 are provided in a substantially intermediate portion of the base portion 111 in the longitudinal direction such that the pillar portions 112 face each other in the X direction. The beam 113 is provided such that the longitudinal direction is set to be the X direction. Both end portions of the beam 113 are fixed to two of the pillar portions 112.

The housing portion 12 is supported by the leg portion 11 so as to cover two of the pillar portions 112. The housing portion 12 is provided with a feeding portion 121, a printing unit 122, a pair of feed rollers 123 (refer to FIG. 3), and a cutting portion 125 therein. A discharging port 124 is provided on the +Y side of the housing portion 12. In addition, the housing portion 12 is provided with an operation panel 126 which is a user interface. The receiving member mode and the winding mode are switched to each other based on an operation with respect to the operation panel 126, for example.

A rolling body obtained by winding the printing medium P in a roll shape is set in the feeding portion 121. The feeding portion 121 allows the rolling body to rotate such that the printing medium P is fed from the set rolling body. Note that, similar to a winding unit 14 described below, a plurality of the printing mediums P (rolling bodies) which have different widths are possibly set to the feeding portion 121. The maximum width of the settable printing medium P is, for example, 64 inches.

The printing unit 122 performs the printing on the printing medium P by using a serial method. The printing unit 122 is provided with a carriage 1221 and a carriage guide 1222. A plurality of ink jet heads (not shown) are mounted on the carriage 1221. The carriage 1221 is capable of reciprocally moving in the X direction. The carriage guide 1222 guides the movement of the carriage 1221 to the X direction. When the ink jet head discharges ink while the carriage 1221 moves in the X direction, the printing is performed on the printing medium P. As such, the printer 100 includes the printing unit 122 which performs the printing on the printing medium P.

One or more pairs of feed rollers 123 are provided between the feeding portion 121 and the discharging port 124 on the feeding path of the printing medium P (only one pair of feed rollers 123 are illustrated in the drawings). The pair of feed rollers 123 intermittently transport the printing medium P which is fed from the feeding portion 121 to the discharging port 124 during the movement of the carriage 1221.

In the receiving member mode, the cutting portion 125 cuts the printed part Pa, whereas in the winding mode, the cutting portion 125 does not cut the printed part Pa. Note that, in a case where the printing is performed by using the cut medium, the cutting is not performed by the cutting portion 125 even in the receiving member mode. The cutting portion 125 is provided between the printing unit 122 and the discharging port 124 on the feeding path of the printing medium P. The cutting portion 125 is provided with a cutter 1251 and a cutter guide 1252. The cutter 1251 is capable of reciprocally moving in the X direction, and the printing medium P is cut in the width direction. The cutter guide 1252 guides the movement of the cutter 1251 in the X direction. When the cutter 1251 moves in the X direction in a state where a rear end of the printed part Pa is transported to the cutter 1251, the printed part Pa is cut off.

The first receiving member mounting portion 13 is a frame unit which is formed into a frame shape. The first receiving member mounting portion 13 is positioned between the printing unit 122 and the winding unit 14 on the feeding path of the printing medium P. That is, the printer 100 is provided with the frame unit which is positioned between the printing unit 122 and the winding unit 14 on the feeding path of the printing medium P. In addition, the frame unit is configured to include a receiving member detachable portion which is capable of detaching the receiving member 3 for receiving the printing medium P in a case where the printing medium P is not wound by the winding unit 14, and a medium supporting portion which supports the printing medium P in a case where the printing medium P is wound by the winding unit 14. With such a configuration, it is possible to attach and detach the receiving member 3 with respect to the frame unit, and thus it is possible to easily switch a case where the receiving member 3 is used and a case where the receiving member 3 is not used are with each other without attaching and detaching the frame unit. Further, the frame unit includes a medium supporting portion, and thus it is possible to efficiently use the frame unit even in the case where the receiving member 3 is not used. The first receiving member mounting portion 13 as the frame unit will be described in detail.

The receiving member 3 is detachably mounted between the first receiving member mounting portion 13 and the second receiving member mounting portion 16. In the receiving member mode, the cut-off printed part Pa is discharged so as be fall down to the mounted receiving member 3 which is mounted between the first receiving member mounting portion 13 and the second receiving member mounting portion 16. On the other hand, in the winding mode, the receiving member 3 is not necessary and the receiving member 3 may interfere with the printed part Pa which is transported to winding unit 14 from the discharging port 124 in a state where the receiving member 3 is mounted between the first receiving member mounting portion 13 and the second receiving member mounting portion 16. For this reason, in the receiving member mode, the receiving member 3 is mounted between the first receiving member mounting portion 13 and the second receiving member mounting portion 16 (refer to FIG. 1 to FIG. 3); whereas in the winding mode, the receiving member 3 is detached between the first receiving member mounting portion 13 and the second receiving member mounting portion 16 (refer to FIG. 4 to FIG. 6). It can be said that the first receiving member mounting portion 13 is configured to include a receiving member detachable portion (specifically, a mounting-side engaging portion 133 described below) on which the receiving member 3 is detachably mounted. In addition, the receiving member 3 is for receiving the printing medium P in a case where the printing medium P is not wound by the winding unit 14. In other words, the frame unit includes a receiving member detachable portion on which the receiving member 3 for receiving the printing medium P is detachably mounted in the case where the printing medium P is not wound by the winding unit 14. Note that, in the winding mode, the receiving member 3 may be mounted on the second receiving member mounting portion 16 as it is.

An end portion on the +Y side of the receiving member 3 is detachably mounted on the first receiving member mounting portion 13. The first receiving member mounting portion 13 is formed of metallic extruding materials in combination. The first receiving member mounting portion 13 is provided with a mounting bar 131, two bar supporting materials 132, and a plurality of (four) mounting-side engaging portions 133 (refer to FIG. 9). The mounting-side engaging portion 133 is also simply referred to as an engaging portion. That is, in the frame unit, the receiving member detachable portion is an engaging portion which is engaged with the receiving member 3. With this, it is possible to preferably attach the receiving member 3 to the frame unit by using the engaging portion.

The mounting bar 131 is provided such that the longitudinal direction is set to be the width direction (the X direction) of the printing medium P. The mounting bar 131 is positioned between the discharging port 124 and the winding unit 14 in the Z direction, and is positioned on the +Y side further than the discharging port 124 and the winding unit 14 in the Y direction (refer to FIG. 3). In the receiving member mode, the end portion on the +Y side of the receiving member 3 is so mounted on the mounting bar 131 as to be suspended (refer to FIG. 1 to FIG. 3). In the winding mode, the mounting bar 131 guides the printed part Pa which is transported to the −Z side (lower side) from the discharging port 124 so as to be bent to the +Y side (the side opposite to the winding unit 14) (refer to FIG. 4 to FIG. 6) in a state where the end portion on the +Y side of the receiving member 3 is detached. That is, the frame unit includes a medium supporting portion which supports the printing medium P in a case where the printing medium P is wound by the winding unit 14. Specifically, a part coming in contact with the printing medium P in the mounting bar 131 corresponds to the medium supporting portion (refer to FIG. 4 and FIG. 6).

Figure 9:
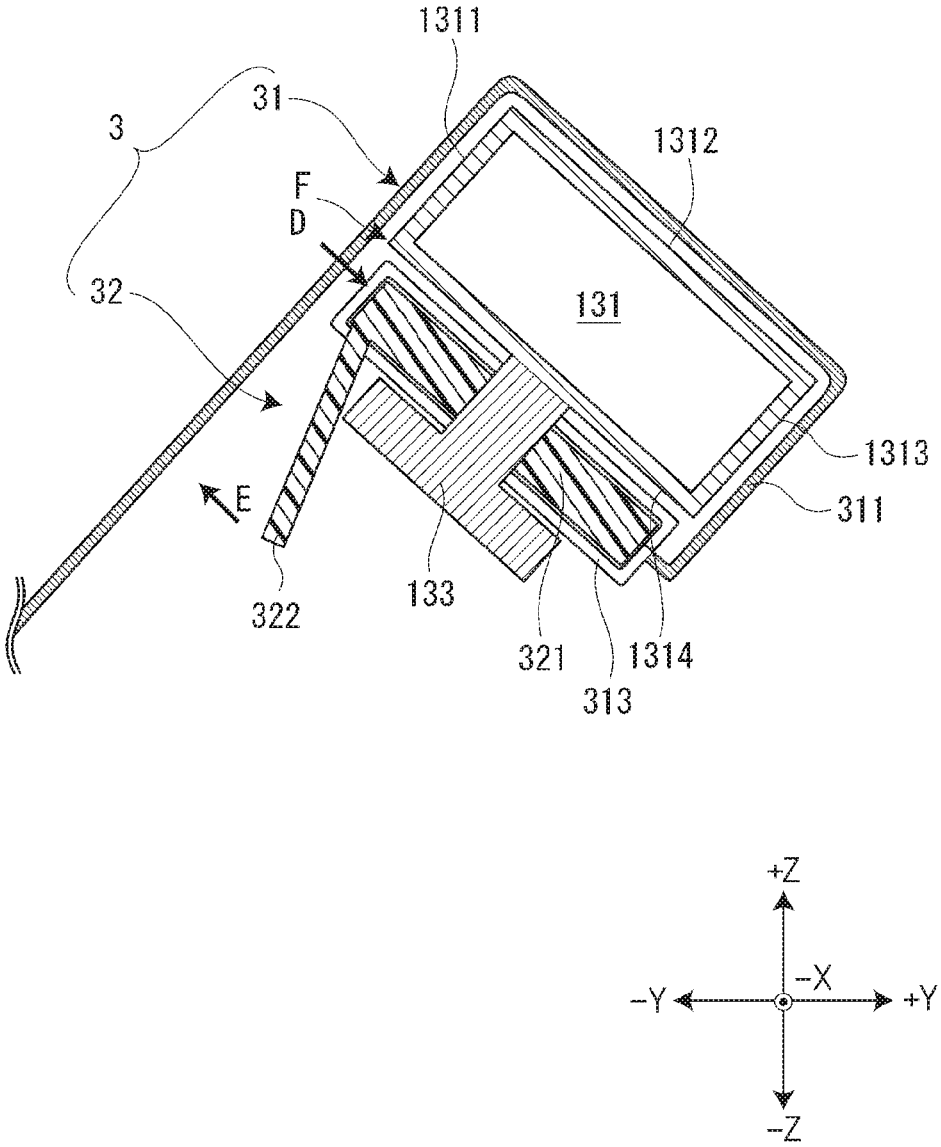
FIG. 9 is a diagram illustrating a state where the receiving member is mounted to a first receiving member mounting portion.

In addition, the mounting bar 131 is formed into a rectangular tube shape having a substantially rectangular cross-section, and in four circumferential surfaces of the mounting bar 131, a surface diagonal to the −Y side and +Z side is referred to as a first circumferential surface 1311, a surface diagonal to the +Y side and +Z side is referred to as a second circumferential surface 1312, a surface diagonal to the +Y side and the −Z side is referred to as a third circumferential surface 1313, and a surface diagonal to the −Y side and the −Z side is referred to as a fourth circumferential surface 1314 (refer to FIG. 9).

Two of the bar supporting materials 132 support both end portions of the mounting bar 131. The bar supporting materials 132 are provided such that the longitudinal direction is set to be the diagonal Y direction in which the +Y side faces the +Z side. An angle of the bar supporting material 132 with respect to the Y direction is variable, and the angle of the bar supporting material 132 with respect to the Y direction in the winding mode is greater (closer to the vertical direction) than that in the receiving member mode (refer to FIG. 3 and FIG. 6). One end of the bar supporting material 132 is fixed to the end portion on the +Y side of the base portion 111, and the other end of the bar supporting material 132 is fixed to the end portion of the mounting bar 131.

Four of the mounting-side engaging portions 133 are provided in the mounting bar 131 with intervals in the X direction. That is, in the frame unit, the plurality of engaging portions are provided along the width direction of the printing medium P. With this, it is possible to disperse loads to the plurality of engaging portions, and thus the loads applied to the frame unit can be dispersed. The mounting-side engaging portions 133 are projected from the fourth circumferential surface 1314 of the mounting bar 131. The mounting-side engaging portions 133 are engaged with receiving-member side engaging portions 321 (refer to FIG. 8) described below.

An end portion on the −Y side of the receiving member 3 is detachably mounted on the second receiving member mounting portion 16. The second receiving member mounting portion 16 is formed into a cylindrical shape, and is cantilevered by the end portion on the −Y side of the base portion 111 on the +X side such that the longitudinal direction is set to be the X direction. That is, the second receiving member mounting portion 16 is provided in parallel to the first receiving member mounting portion 13, and is provided on the −Y side and the −Z side with respect to the first receiving member mounting portion 13.

The winding unit 14 winds the printing medium P on which the printing is performed by the printing unit 122. Specifically, in the winding mode, the winding unit 14 winds the printed part Pa which is slackened from the discharging port 124 to the −Z side (the lower side) such that the printed surface is set to be the outer side (refer to FIG. 6). Note that, the winding unit 14 may wind the printing medium P such that the printed surface is set to be the inner side (indicated by a two-dot chain line in FIG. 6). The winding unit 14 winds the printed part Pa based on the detecting result by the slack detecting sensor 15. That is, the winding unit 14 does not wind the printed part Pa until the fact that a slack amount of the printed part Pa approaches a predetermined amount is detected by the slack detecting sensor 15. The winding unit 14 winds a certain amount of the printed part Pa when the slack amount of the printed part Pa is gradually increased in accordance with a transporting operation by the pair of feed rollers 123, and thus the fact that the slack amount approaches a predetermined amount is detected by the slack detecting sensor 15. Here, "a predetermined amount" of the slack amount means, for example, a slack amount of the extent to which a lower end (a part positioned on the most −Z side) of a slackened part of the printed part Pa is proximate to a ground on which the printer 100 is installed. With this, it is possible to pull up the lower end of the slackened part of the printed part Pa to the +Z side by reducing the slack amount before the lower end of the slackened part of the printed part Pa comes in contact with the ground. In addition, the winding unit 14 is provided with a driving unit 141 and a driven unit 142.

The driving unit 141 is provided with a driving-side engaging portion 1411, a driving-side flange 1412, and a winding box 1413. The winding box 1413 is an example of a wiring connection portion which is connected to a first receiving and emitting unit and a second receiving and emitting unit which are described below. The driving-side engaging portion 1411 is engaged with an end portion of a paper tube C on the +X side in which the printing medium P is wound. That is, the driving-side engaging portion 1411 is inserted into the paper tube C from the end portion of a paper tube C on the +X side, and the paper tube C is interposed between the driving-side engaging portion 1411 and a driven-side engaging portion (not shown) described below. The driving-side engaging portion 1411 is rotatably held on the surface on the −X side of the winding box 1413. The driving-side flange 1412 is provided on the same axis as that of the driving-side engaging portion 1411. Although not shown, a winding motor which is a driving source for causing the driving-side engaging portion 1411 to rotate, a detecting circuit which is connected to the slack detecting sensor 15, a control circuit for controlling the winding motor based on the output from the detecting circuit, and the like are provided in the winding box 1413. The winding box 1413 is attached to the +Y side of the pillar portion 112 on the +X side. Note that, a light-emitting side supporting member 1512 and a light-receiving side supporting member 1522 which are described below are detachably mounted on the surface on the −X side of the winding box 1413.

The driven unit 142 is provided with the driven-side engaging portion, a driven-side flange 1422, and a holding arm 1423. The driven-side engaging portion is engaged with the end portion of the paper tube C on the −X side. That is, the driven-side engaging portion is inserted into the paper tube C from the end portion of the paper tube C on the −X side, and the paper tube C is interposed between the driven-side engaging portion and the driving-side engaging portion 1411. The driven-side engaging portion is held so as to rotate around the holding arm 1423. The driven-side flange 1422 is provided on the same axis as that of the driven-side engaging portion. The holding arm 1423 is provided so as to extend to the Y direction in which the +Y side faces the −X direction from the beam 113, and holds the driven-side engaging portion so as to rotate around a tip end portion thereof. The holding arm 1423 is supported by the beam 113 so as to be movable in the X direction along the beam 113.

When a user moves the holding arm 1423 along the beam 113 in the X direction, a position of the driven-side engaging portion in the X direction is adjusted so as to correspond to a length of the paper tube C, that is, a width of the printing medium P. With this, the winding unit 14 can wind various types of printing mediums P having different widths.

The driving-side engaging portion 1411 rotates such that the paper tube C which is interposed between the driving-side engaging portion 1411 and the driven-side engaging portion rotates, by using the winding motor as a driving source. The driven-side engaging portion rotates in accordance with the driving-side engaging portion 1411 via the paper tube C. With this, the printed part Pa which is slackened to the −Z side from the discharging port 124 is wound around the paper tube C while being guided to the width direction by the driving-side flange 1412 and the driven-side flange 1422.

The slack detecting sensor 15 detects that the slack amount of the printed part Pa approaches a predetermined amount. The slack detecting sensor 15 a transmission-type photo-interrupter, and is provided with a light emitting unit 151 and a light receiving unit 152. When the slack amount of the printed part Pa approaches a predetermined amount, the detected light from the light emitting unit 151 is shielded by the printed part Pa, and thus the light is not received by the light receiving unit 152. With this, the slack detecting sensor 15 detects that the slack amount of the printed part Pa approaches a predetermined amount. As described above, "a predetermined amount" of the slack amount means, for example, a slack amount of the extent to which a lower end (a part positioned on the most −Z side) of a slackened part of the printed part Pa is proximate to a ground on which the printer 100 is installed. The slack detecting sensor 15 is provided in a position in which the printed part Pa in the above-described state (in the state where the lower end of the slackened part of the printed part Pa is proximate to a ground) can be detected.

In short, the printer 100 is provided with a detecting unit which can detect that the slack amount of the printing medium P wound by the winding unit 14 approaches a predetermined amount. With this, it is possible to detect that the slack amount of the printing medium P approaches a predetermined amount, and thus it is possible to prevent the printing medium P from being excessively slackened.

In addition, the detecting unit can be displaced to the detecting position where the slack amount that approaches a predetermined amount is detected and the retractable position which is retracted from the detecting position. With this, the detecting unit is displaced to the retractable position, and thus in the case where the detecting unit is not used, it is possible to secure the space in the vicinity of the feeding path of the printing medium P. The displacement of the detecting unit will be described below in detail.

The light emitting unit 151 is provided with a light emitting unit 1511 and a light-emitting side supporting member 1512. The light emitting unit 1511 an example of is of the first detecting unit. The light emitting unit 1511 is formed into the substantially rectangular plate shape. The light emitting element (not shown) is incorporated into the light emitting unit 1511, and emits the detected light. The light emitting element is, for example, an infrared-emitting diode. The light emitting unit 1511 is electrically connected to the detecting circuit in the winding box 1413 by a light-emitting side wire 1513. The light-emitting side wire 1513 is an example of a first wire which connects the first receiving and emitting unit and the winding unit 14.

The light-emitting side supporting member 1512 is formed into a substantially rectangular plate shape which is thinner than the light emitting unit 1511, and is detachably mounted to the position close to the +Y side of the surface on the −X side with respect to the base portion 111 on the +X side. Here, the base portion 111 functions as a supporting member to which the light-emitting side supporting member 1512 is attached. That is, the base portion 111 is an example of the supporting member. The light-emitting side supporting member 1512 is attached to the base portion 111 by a small screw 1514. In addition, the light-emitting side supporting member 1512 is not shown, but can be attached to the surface on the −X side of the winding box 1413 by the small screw 1514. That is, the light-emitting side supporting member 1512 can be replaced with the winding box 1413 from the base portion 111 on the +X side. In other words, the light emitting unit 151 is detachably mounted on each of the base portion 111 on the +X side and the winding box 1413.

The light-emitting side supporting member 1512 supports the light emitting unit 1511 so as to rotate around the Y-axis via a hinge (not shown). That is, the light emitting unit 1511 can be positioned in a first position (refer to FIG. 6) which is substantially orthogonal (substantially parallel to the XY plane) to the light-emitting side supporting member 1512, and a second position (refer to FIG. 3) which is substantially parallel to (substantially parallel to the YZ plane) to the light-emitting side supporting member 1512 in a state of being mounted to the base portion 111. In the state where the light emitting unit 1511 is positioned in the first position, the light can be received and emitted between a light emitting unit 1511 and a light receiving unit 1521. In addition, in the state where the light emitting unit 1511 is positioned in the first position, the light emitting unit 1511 comes in contact with the mounted receiving member 3 mounted between the first receiving member mounting portion 13 and the second receiving member mounting portion 16. On the other hand, in the state where the light emitting unit 1511 is positioned in the second position, the light cannot be received and emitted between the light emitting unit 1511 and the light receiving unit 1521. In addition, in the state where the light emitting unit 1511 is positioned in the second position, the light emitting unit 1511 does not come in contact with the receiving member 3 mounted between the first receiving member mounting portion 13 and the second receiving member mounting portion 16. The detected light is emitted from a tip end part of the light emitting unit 1511. Accordingly, the light emitting part of the detected light in the light emitting unit 1511 is configured to be largely moved when the light emitting unit 1511 is displaced.

Here, in the receiving member mode, when the light emitting unit 1511 is positioned in the first position, the light emitting unit 1511 comes in contact with the receiving member 3, and thus the light emitting unit 1511 interferes with the receiving member 3. In contrast, in the printer 100 in the receiving member mode, the light emitting unit 1511 can be positioned at the second position, and thus it is possible to prevent the light emitting unit 1511 from interfering with the receiving member 3. In addition, the light emitting unit 1511 is supported by the light-emitting side supporting member 1512 through a hinge, and thus the light emitting unit 1511 can be positioned at the first position and the second position in a state where the light-emitting side supporting member 1512 is attached to the base portion 111. Accordingly, the user is not required to perform an operation of attaching and detaching the light emitting unit 1511 such that the printer 100 switches the position of the light emitting unit 1511 to the first position and the second position.

In other words, the detecting unit allows at least one (here, the light emitting unit 1511) of the first detecting unit and the second detecting unit to be rotated so as to be displaced between the detecting position and the retractable position. With this, it is possible to easily displace at least one of the first detecting unit and the second detecting unit without replacing components.

The light receiving unit 152 is provided with the light receiving unit 1521 and the light-receiving side supporting member 1522. The light receiving unit 1521 is an example of the second detecting unit. The light receiving unit 1521 is formed into a substantially "U" shape when seen from the Z direction. The light receiving element (not shown) is incorporated into the light receiving unit 1521, and receives the detected light from the light emitting element. The light receiving element is, for example, an infrared phototransistor. The light receiving unit 1521 is electrically connected to the detecting circuit in the winding box 1413 by a light-receiving side wiring 1523. The light-receiving side wiring 1523 is an example of a second wiring which connects the second receiving and emitting unit and the winding unit 14.

The light-receiving side supporting member 1522 is formed into a box shape the −Y side is opened by diagonally cutting the corner portions on the +Y side and the +Z side. The light receiving unit 1521 is supported by the light-receiving side supporting member 1522 on the +Y side. The light-receiving side supporting member 1522 is detachably mounted on the base portion 111 on the +X side so as to cover the end portion on the +Y side of the base portion 111 on the +X side. The light-receiving side supporting member 1522 is attached to the base portion 111 by a small screw 1524 (refer to FIG. 6). In addition, the light-receiving side supporting member 1522 can be attached to the surface on the −X side of the winding box 1413 by using the small screw 1524 (refer to FIG. 3). That is, the light-receiving side supporting member 1522 can be replaced from the base portion 111 on the +X side to the winding box 1413. That is, the light receiving unit 152 is detachably mounted on each of the base portion 111 on the +X side and the winding box 1413. Note that, the small screws 1514 and 1524 which are used to attach the light-emitting side supporting member 1512 and the light-receiving side supporting member 1522 to the base portion 111 and the winding box 1413 are preferably manual type screws (hand-cranked screws), and among them, a screw with a captive washer is further preferably used so as to improve the workability.

Here, as described above, the light emitting unit 151 is detachably mounted on the surface on the −X side of the winding box 1413. Similarly, the light receiving unit 152 is detachably mounted on the surface on the −X side of the winding box 1413. Therefore, at the time of assembling the printer 100, the light emitting unit 151 and the light receiving unit 152 are temporarily mounted on the winding box 1413, that is, it is possible to attach the winding box 1413 to the pillar portion 112 in a state of temporary assembly. With this, in a state where the light emitting unit 151 hangs down from the winding box 1413 via the light-emitting side wire 1513, and the light receiving unit 152 hangs down from the winding box 1413 via the light-receiving side wiring 1523, it is possible to avoid performing the attaching operation of the winding box 1413. Accordingly, it is possible to prevent the light-emitting side wire 1513 or the light-receiving side wiring 1523 from being pulled and thus disconnected in the middle of the operation of attaching the winding box 1413.

In other words for the above configuration, the detecting unit is configured so as to be detachably mounted on the winding unit 14. When the detecting unit is mounted on the winding unit 14, the winding unit 14 and the detecting unit can be set as a pair. For this reason, it is possible to easily store the detecting unit so as to be less likely to be lost.

In addition, in the receiving member mode, the light receiving unit 152 is not necessary and is provided at the end portion on the +Y side of the base portion 111, and thus the user stumbles on the light receiving unit 152 at the time of passing through the vicinity of the printer 100. For this reason, the light receiving unit 152 is detached from the base portion 111 and is mounted on the winding box 1413 in the receiving member mode. Note that, even in the receiving member mode, the light receiving unit 152 may be in a state of being mounted on the base portion 111.

The weight equipment 2 is mounted at an end portion (lower end portion) on the −Z side of the printed part Pa slackened to the −Z side from the discharging port 124. With this, the shape of the slackened part of the printed part Pa is stabilized.

The receiving member 3 is mounted between the first receiving member mounting portion 13 and the second receiving member mounting portion 16 with the slackness on the −Z side. The mounted receiving member 3 receives the printed part Pa discharged from the discharging port 124. In a case where a plurality of printed parts Pa are sequentially transported from the discharging port 124, the plurality of printed parts Pa are sequentially stacked on the receiving member 3 so as to be discharged to the receiving member 3. Meanwhile, the receiving member 3 will be described below in detail.

In a case where the printer 100 which is configured as described above is used in the receiving member mode, the user moves the light emitting unit 1511 to the second position in advance, and mounts the light receiving unit 152 on the winding box 1413. In addition, the end portion on the +Y side of the receiving member 3 is mounted on the first receiving member mounting portion 13, and the end portion on the −Y side of the receiving member 3 is mounted on the second receiving member mounting portion 16. In addition, in the receiving member mode, in the printer 100, the printed part Pa is cut off by using the cutting portion 125 after the printing is performed on the printing medium P by the printing unit 122, and the cut-off printed part Pa is discharged to the mounted receiving member 3 which is mounted between the first receiving member mounting portion 13 and the second receiving member mounting portion 16.

On the other hand, in a case where the printer 100 is used in the winding mode, the user detaches the end portion on the +Y side of the receiving member 3 from the first receiving member mounting portion 13, and detaches the end portion on the −Y side of the receiving member 3 from the second receiving member mounting portion 16. In addition, the user moves the light emitting unit 1511 to the first position and mounts the light receiving unit 152 on the base portion 111. Further, the user extracts the tip end portion of the printing medium P to the winding unit 14 from the discharging port 124 by passing through the +Y side of the mounting bar 131 so as to be bonded to the paper tube C set in the winding unit 14. In addition, in the winding mode, the printer 100 performs the printing on the printing medium P by the printing unit 122 while transporting the printing medium P by using a roll-to-roll method, and winds the printed part Pa by the winding unit 14 based on the detection result of the slack detecting sensor 15, without cutting off the printed part Pa by the cutting portion 125. In this case, the first receiving member mounting portion 13 comes in contact with the printed part Pa facing the winding unit 14 from the discharging port 124, and guides feeding of the printed part Pa.

Figure 6:
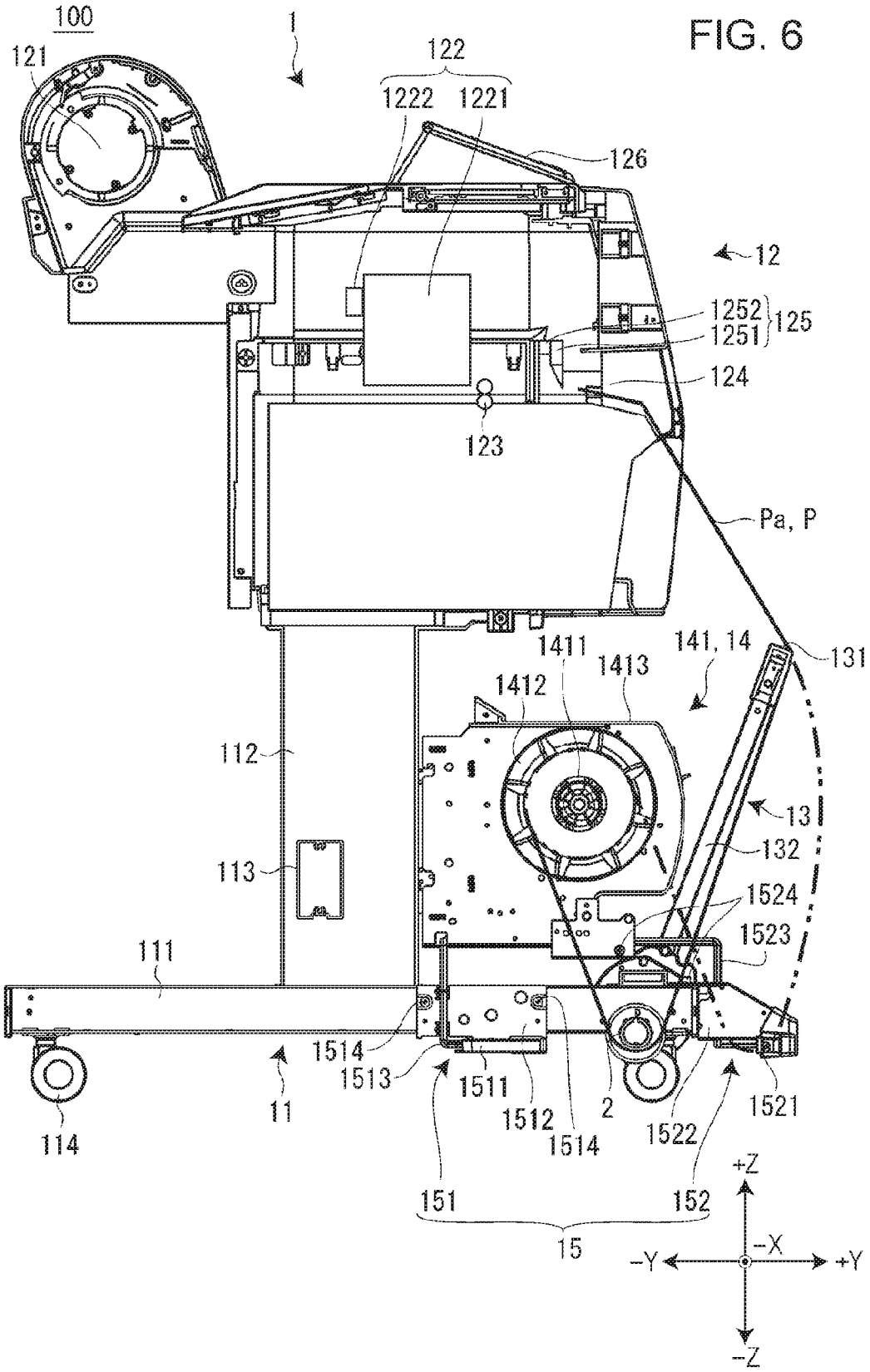
FIG. 6 is a sectional view of the printer (the winding mode).

Here, the slack detecting sensor 15 is provided with the light emitting unit 1511 and the light receiving unit 1521 as separated units (the light emitting unit 151 and the light receiving unit 152), and thus the light emitting unit 1511 and the light receiving unit 1521 can be separately disposed, and can correspond to various winding conditions. For example, as illustrated in FIG. 6, in a case where the printing medium P (indicated by a two-dot chain line in FIG. 6) is wound such that the printed surface is positioned inside, the printing medium P passes through the +Y side as compared with the case where the printing medium P (shown by a solid line in the FIG. 6) is wound such that the printed surface is positioned outside. Also in this case, the slackened printing medium P passes through between the light emitting unit 1511 and the light receiving unit 1521, and thus the fact that the slack amount of the printing medium P approaches a predetermined amount is detected.

Figure 7:
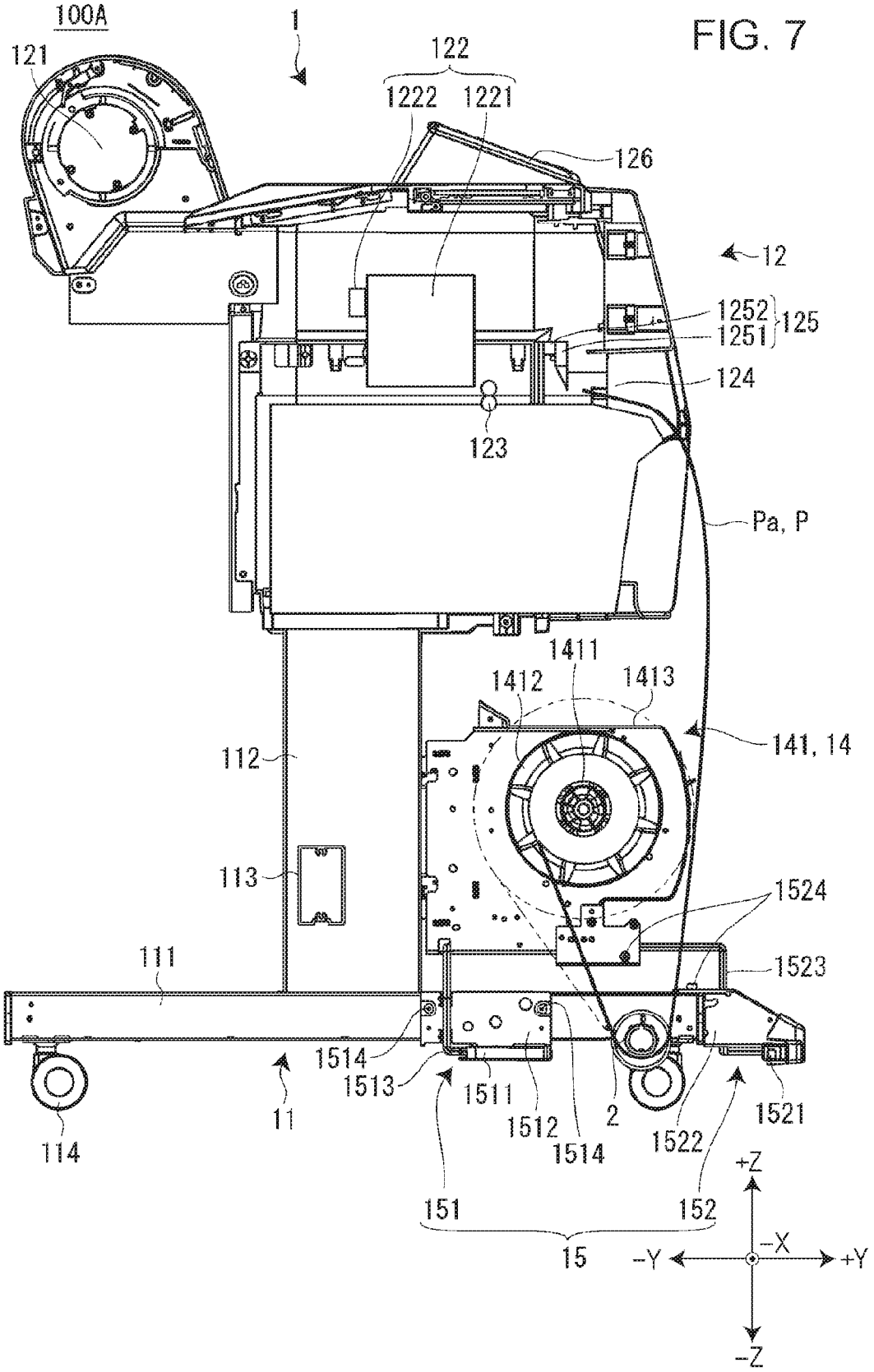
FIG. 7 is a sectional view of a printer (a winding mode) according to comparative example.

The guide for the feeding of the printed part Pa by the first receiving member mounting portion 13 will be further described with reference to FIG. 6 and FIG. 7. As illustrated in FIG. 7, unlike the printer 100 of the embodiment, in a printer 100A according to the comparative example, the receiving member 3 is not detachably mounted on the first receiving member mounting portion 13, but the first receiving member mounting portion 13 is detachably mounted on the base portion 111. For this reason, in the printer 100A, the first receiving member mounting portion 13 is detachably mounted, and thus the receiving member 3 is detached. That is, the printer 100A in the winding mode is used in a state where the first receiving member mounting portion 13 is detached from the base portion 111. For this reason, in the printer 100A, the printed part Pa discharged from the discharging port 124 is transported to the −Z side (the lower side) through the vicinity of the winding unit 14. With this, as a winding amount of the printed part Pa which is wound around the paper tube C is increased, it is possible to prevent the printed part Pa which is transported to the −Z side (the lower side) from the discharging port 124 from rubbing against the printed surface of the printed part Pa, that is, the printing image, which is wound around the paper tube C. For this reason, in the printer 100A, there is a concern in that the printed surface of the printed part Pa is scratched.

In contrast, the printer 100 according to the embodiment is configured such that the receiving member 3 is detachably mounted on the first receiving member mounting portion 13, as described above, and in the winding mode, the receiving member 3 is used in a state of being detached from the first receiving member mounting portion 13. That is, in the printer 100, the first receiving member mounting portion 13 can be used in a state of being fixed to the base portion 111 even in the winding mode. As illustrated in FIG. 6, in the winding mode, the first receiving member mounting portion 13 guides the printed part Pa transported to the −Z side (the lower side) from the discharging port 124 to be curved to the +Y side (the side opposite to the winding unit 14). The meaning of "the first receiving member mounting portion 13 guides the printed part Pa" is that "the first receiving member mounting portion 13 corresponds to a portion of a path guiding the printed part Pa". That is, the first receiving member mounting portion 13 functions as a medium supporting portion supporting the printing medium P. With this, even in a case where a winding amount of the printed part Pa which is wound around the paper tube C is increased, it is possible to prevent the printed part Pa which is transported to the −Z side (the lower side) from the discharging port 124 from rubbing against the printed surface of the printed part Pa which is wound around the paper tube C. For this reason, it is possible to prevent the printed surface of the printed part Pa from being scratched. In addition, the first receiving member mounting portion 13 is not required to be detachable, and thus it is possible to make the first receiving member mounting portion 13 have the robustness.

In other words for the above configuration, in a case where the printing medium P is wound by the winding unit 14, the medium supporting portion supports the printing medium P such that a part of the printing medium P which is wound by the winding unit 14, and a part of the printing medium P before being wound by the winding unit 14 do not contact with each other. With this, it is possible to prevent the part of the printing medium P which is wound by the winding unit 14 from rubbing against the part of the printing medium P before being wound by the winding unit 14.

Figure 8:
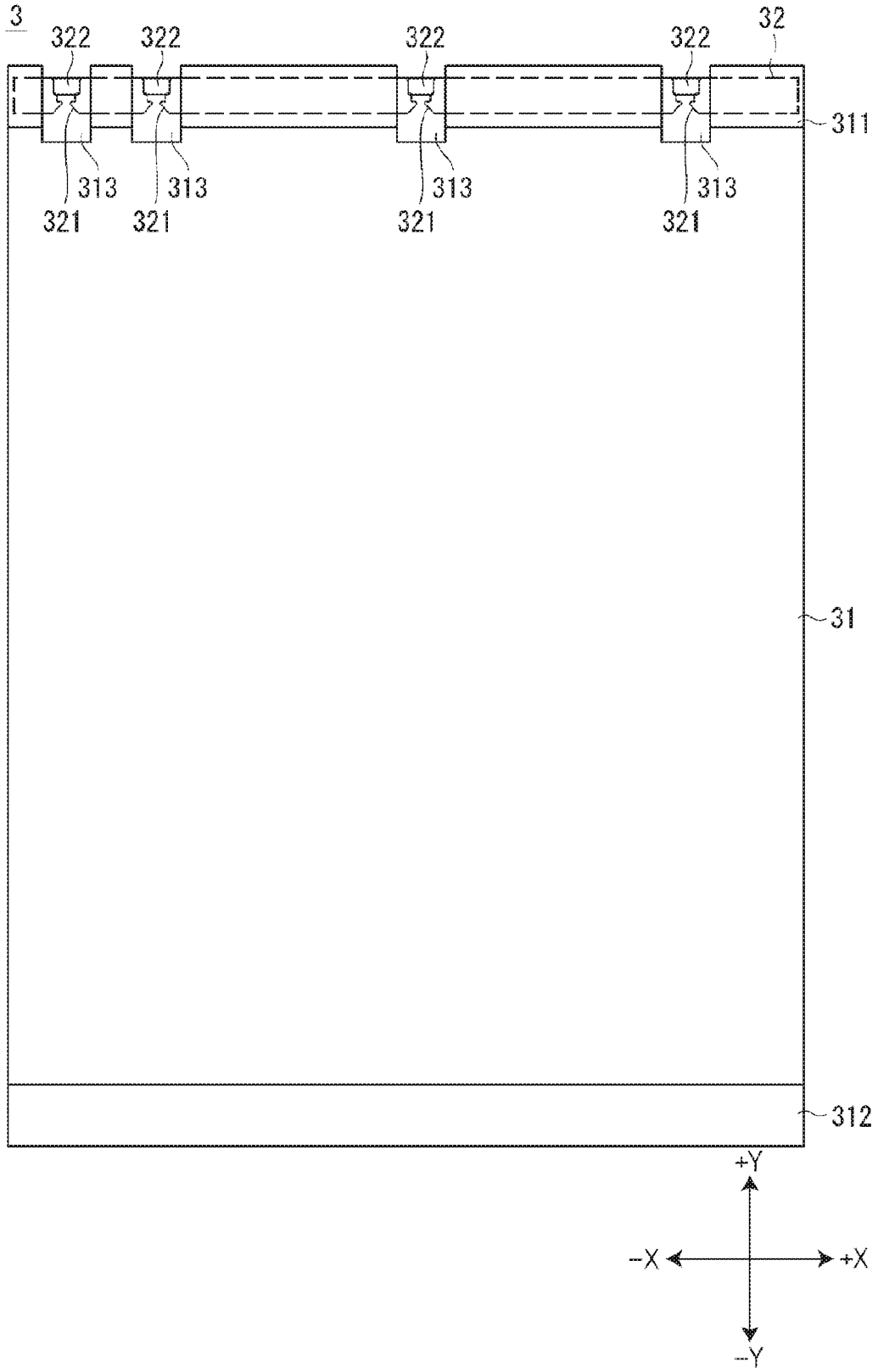
FIG. 8 is a diagram illustrating a receiving member.

The receiving member 3 and an attaching and detaching operation of the receiving member 3 with respect to the first receiving member mounting portion 13 will be further described with reference to FIG. 8 and FIG. 9. The receiving member 3 is provided with a sheet material 31 and a plate 32.

The sheet material 31 is formed into a substantially rectangular shape, and the width dimension (dimension in the X direction) is larger than the width of the printing medium P (dimension in the X direction) of the settable maximum width. The material of the sheet material 31 is, for example, fabric. A first cylindrical portion 311 is provided at an end portion on the +Y side of the sheet material 31 and a second cylindrical portion 312 is provided at an end portion on the −Y side of the sheet material 31. The first cylindrical portion 311 is folded and stitched such that the end portion on the +Y side of the sheet material 31 is formed into a cylindrical shape. The sheet material 31 is inserted into the first cylindrical portion 311. In addition, a plurality of (here, four) notches 313 are provided in the first cylindrical portion 311. Four of the notches 313 are correspondingly provided to the above-described four mounting-side engaging portions 133 with intervals in the X direction. Note that, the number of the notches 313 may be five or more, or may be one to three. Similar to the first cylindrical portion 311, the second cylindrical portion 312 is folded and stitched such that the end portion on the −Y side of the sheet material 31 is formed into a cylindrical shape. The second cylindrical portion 312 is mounted on the second receiving member mounting portion 16 so as to cover the second receiving member mounting portion 16 from the tip end side (−X side) of the second receiving member mounting portion 16.

The plate 32 is formed into an elongated plate shape in the X direction. That is, the length of the plate 32 in the X direction is substantially the same as the width dimension (the length in the X direction) of the sheet material 31. In addition, the width (the length in the Y direction in FIG. 8, and the length of the diagonal surface so as to be downwardly sloped in FIG. 9) of the plate 32 is slightly smaller than the width (the length of the diagonal surface so as to be downwardly sloped in FIG. 9) of the fourth circumferential surface 1314 of the mounting bar 131 (refer to FIG. 9). The plate 32 is formed of a resin, for example. A plurality of (four) receiving-member side engaging portions 321 and a plurality of (four) knob portions 322 are provided on the plate 32. Four of the receiving-member side engaging portion 321 are provided to the plate 32 with intervals in the longitudinal direction (the X direction), and are engaged with four of the mounting-side engaging portions 133. The receiving-member side engaging portion 321 is formed such that one of the long side portions of the plate 32 is notched. Four of the knob portions 322 are correspondingly positioned at four of the receiving-member side engaging portions 321. The knob portion 322 is formed so as to be folded toward the corresponding receiving-member side engaging portion 321 from the other long side portion of the plate 32. The knob portion 322 becomes a portion which is peaked when the engagement of the receiving-member side engaging portion 321 and the mounting-side engaging portion 133 is released. Note that, the number of each of the receiving-member side engaging portion 321 and the knob portion 322 may be five or more, or may be one to three.

As illustrated in FIG. 9, when the end portion on the +Y side of the receiving member 3 is mounted on the first receiving member mounting portion 13, first, the end portion on the +Y side of the receiving member 3 is wound from the mounting bar 131 from the +Z side (upper side). That is, the end portion on the +Y side of the receiving member 3 is wound around the mounting bar 131 from the first circumferential surface 1311 to the fourth circumferential surface 1314 via the second circumferential surface 1312 and the third circumferential surface 1313. At this time, the mounting-side engaging portion 133 which is provided on the fourth circumferential surface 1314 is exposed to the notch 313 which is provided on the sheet material 31. In this state, the receiving-member side engaging portion 321 and the mounting-side engaging portion 133 are engaged with each other by pressing the plate 32 in the direction of arrow D such that the mounting-side engaging portion 133 fits into the receiving-member side engaging portion 321, and thus the end portion on the +Y side of the receiving member 3 is mounted to the first receiving member mounting portion 13. On the other hand, when the end portion on the +Y side of the receiving member 3 is detached from the first receiving member mounting portion 13, first, the knob portion 322 is picked and pulled in the direction of arrow E, and thus the mounting-side engaging portion 133 is detached from the receiving-member side engaging portion 321, and the engagement of the receiving-member side engaging portion 321 and the mounting-side engaging portion 133 is released. Subsequently, when the winding of the receiving member 3 wound around the mounting bar 131 is released, the end portion on the +Y side of the receiving member 3 is detached from the first receiving member mounting portion 13.

Here, when the receiving member 3 is provided with the plate 32, even in a state where four of the receiving-member side engaging portions 321 and four of the mounting-side engaging portions 133 are engaged with each other, the sheet material 31 is prevented from being slackened between the receiving-member side engaging portions 321. Therefore, in the printer 100, the printed part Pa comes in contact with wrinkles occurring in the sheet material 31, and thus it is possible to prevent the printed surface of the printed part Pa from being scratched. Note that, it is preferable that the plate 32 has rigidity which is enough to prevent the sheet material 31 from being slackened. In addition, four of the receiving-member side engaging portions 321 are provided on the plate 32, and thus it is not necessary that four of the receiving-member side engaging portions 321 are provided apart from the plate 32, and the number of components can be reduced.

In addition, the mounting-side engaging portion 133 in the winding direction of the receiving member 3 is not provided on the first circumferential surface 1311 and the second circumferential surface 1312 on the upstream side in the winding direction further than the position at a half circumference from the winding start position F, but is provided on the fourth circumferential surface 1314 on the downstream side in the winding direction further than the position at a half circumference from a winding start position F. For this reason, the printed part Pa is received in the receiving member 3 such that the cut-off printed part Pa is long, the rear end portion of the printed part Pa is fell down to the +Y side further than the mounting bar 131, and thus even in the case where the printed part Pa covers the first circumferential surface 1311 and the second circumferential surface 1312 on the upstream side in the winding direction further than the position at a half circumference from the winding start position F, the printed part Pa does not come in contact with the mounting-side engaging portion 133. Accordingly, in the printer 100, when the printed part Pa comes in contact with the mounting-side engaging portion 133, it is possible to prevent the printed surface of the printed part Pa from being scratched. Note that, the third circumferential surface 1313 is also provided on the downstream side in the winding direction further than the position at a half circumference from the winding start position F, and thus the mounting-side engaging portion 133 may be provided on the third circumferential surface 1313.

In other words for the above configuration, refer to the following description. First, the receiving member 3 is attached to the frame unit so as to be wound. In addition, in the winding direction of the receiving member 3, the engaging portion is provided on the downstream side in the winding direction further than the position at a half circumference from the winding start position F. With this, the engaging portion is not provided on the upstream side in the winding direction further than the position at a half circumference from the winding start position F. For this reason, even in a case where the printed part Pa received in the receiving member 3 covers the upstream side in the winding direction further than the position at a half circumference from the winding start position F, the printed part Pa does not come in contact with the engaging portion. Accordingly, according to this configuration, when the printed part Pa comes in contact with the engaging portion, it is possible to prevent the printed surface the printed part Pa from being scratched.

In addition, a knob portion 322 is provided on the plate 32, and the knob portion 322 is picked and pulled such that the engagement of the receiving-member side engaging portion 321 with the mounting-side engaging portion 133 can be released. In this way, the printer 100 is capable of improving workability at the time of releasing the engagement of the receiving-member side engaging portion 321 with the mounting-side engaging portion 133. In the embodiment, the width of the plate 32 (the length of the diagonal surface so as to be downwardly sloped in FIG. 9) is smaller than the width of the fourth circumferential surface 1314 (the length of the diagonal surface so as to be downwardly sloped in FIG. 9) of the mounting bar 131, and it is difficult to pick and pull the entire the plate 32 in the width direction at the time of releasing the engagement of the receiving-member side engaging portion 321 with the mounting-side engaging portion 133, and thus the knob portion 322 is particularly effective.

Further, the width (the length of the diagonal surface so as to be downwardly sloped in FIG. 9) of the plate 32 is slightly smaller than the width (the length of the diagonal surface so as to be downwardly sloped in FIG. 9) of the fourth circumferential surface 1314 of the mounting bar 131. With this, in a state where the receiving-member side engaging portion 321 provided on the plate 32 is engaged with the mounting-side engaging portion 133 provided on the mounting bar 131, it is possible to prevent the plate 32 from being projected from the first circumferential surface 1311, and it is possible to prevent a convex portion from being generated in the receiving member 3 by the plate 32 which is projected from the first circumferential surface 1311. For this reason, the printed part Pa is received in the receiving member 3 such that the cut-off printed part Pa is long, the rear end portion of the printed part Pa is fell down to the +Y side further than the mounting bar 131, and thus even in the case where the printed part Pa covers the first circumferential surface 1311, the convex portion generated in the receiving member 3 does not come in contact with the printed surface of the printed part Pa. Accordingly, in the printer 100, when the convex portion generated in the receiving member 3 comes in contact with the printed surface of the printed part Pa, it is possible to prevent the printed surface of the printed part Pa from being scratched.

As described above, the printer 100 of the embodiment includes the receiving member mode and the winding mode. In the receiving member mode, the printer 100 cuts off the printed part Pa of the printing medium P which is a continuous sheet, and discharges the cut-off printed part Pa to a sheet-like receiving member 3. In the winding mode of the printer 100, the printed part Pa is wound without cutting off the printed part Pa. In addition, the printer 100 is provided with the printing unit 122, the cutting portion 125, the winding unit 14, the first receiving member mounting portion 13, and the second receiving member mounting portion 16. The printing unit 122 performs the printing on the printing medium P. The cutting portion 125 cuts off the printed part Pa. The winding unit 14 winds the printed part Pa. The end portion on the +Y side of the receiving member 3 is detachably mounted on the first receiving member mounting portion 13. The end portion on the −Y side of the receiving member 3 is detachably mounted on the second receiving member mounting portion 16. In addition, in the receiving member mode, the end portion on the +Y side of the receiving member 3 is mounted on the first receiving member mounting portion 13, and in the winding mode, the first receiving member mounting portion 13 guides feeding of the printed part Pa facing the winding unit 14 in a state where the end portion on the +Y side of the receiving member 3 is detached.

With such a configuration, the first receiving member mounting portion 13 functions as a portion on which the end portion on the +Y side of the receiving member 3 is mounted in the receiving member mode, and functions as a guide for guiding feeding of the printed part Pa in the winding mode. Accordingly, in the printer 100, the first receiving member mounting portion 13 on which the end portion on the +Y side of the receiving member 3 is mounted in the receiving member mode can be efficiently used even in the winding mode.

The invention is not limited to the above embodiments, and it is needless to say that various configurations can be employed without departing from the gist of the invention. For example, the present embodiment can be changed to the following forms.

A configuration that the light receiving unit 1521 can be positioned at the first position and the second position may be employed instead of the configuration that the light emitting unit 1511 can be positioned at the first position and the second position. That is, the light receiving unit 1521 may be configured to be capable of being positioned at the first position which can receive and emit the detected light between the light receiving unit 1521 and the light emitting unit 1511, and which comes in contact with the mounted receiving member 3, and at the second position which can receive and emit the detected light between the light receiving unit 1521 and the light emitting unit 1511, and which does not come in contact with the mounted receiving member 3.

In addition, the slack detecting sensor 15 is not limited to a transmission-type photo-interrupter, and may be a reflective photo-interrupter which is provided with the light receiving and emitting unit and a reflector, for example. In this case, one of the light receiving and emitting unit and the reflector may be configured to be positioned at the first position and the second position. That is, one of the light receiving and emitting unit and the reflector may be configured to be capable of being positioned at the first position which can receive and emit the detected light between both of the light receiving and emitting unit and the reflector, and which comes in contact with the mounted receiving member 3, and at the second position which can receive and emit the detected light between both of the light receiving and emitting unit and the reflector, and which does not come in contact with the mounted receiving member 3.

The angle of the bar supporting material 132 with respect to the Y direction may be the same in both of the receiving member mode and the winding mode. That is, the position of the first receiving member mounting portion 13 on which the receiving member 3 is mounted in the receiving member mode mane the same as the position of the first receiving member mounting portion 13 for guiding the printed part Pa in the winding mode. With this, whenever the receiving member mode and the winding mode are switched to each other, the user is not required to perform an operation of changing the position of the first receiving member mounting portion 13. In addition, since the first receiving member mounting portion 13 is not required to be movable, it is possible to enhance the robustness of the first receiving member mounting portion 13.

In other words for the above configuration, the frame unit is configured such that the position in a case where the printing medium P is not wound by the winding unit 14 is the same as the position in a case where the printing medium P is wound by the winding unit 14. With such a configuration, it is possible to easily switch the case where the receiving member 3 is used into a case where the receiving member 3 is not used, without causing the frame unit to be movable.

The printing unit 122 is not limited to a serial type, and may discharge ink by using a line type. Further, the printing unit 122 is not limited to an ink jet type, and may be an electrophotographic type and a thermal type, for example.

Figure 10:
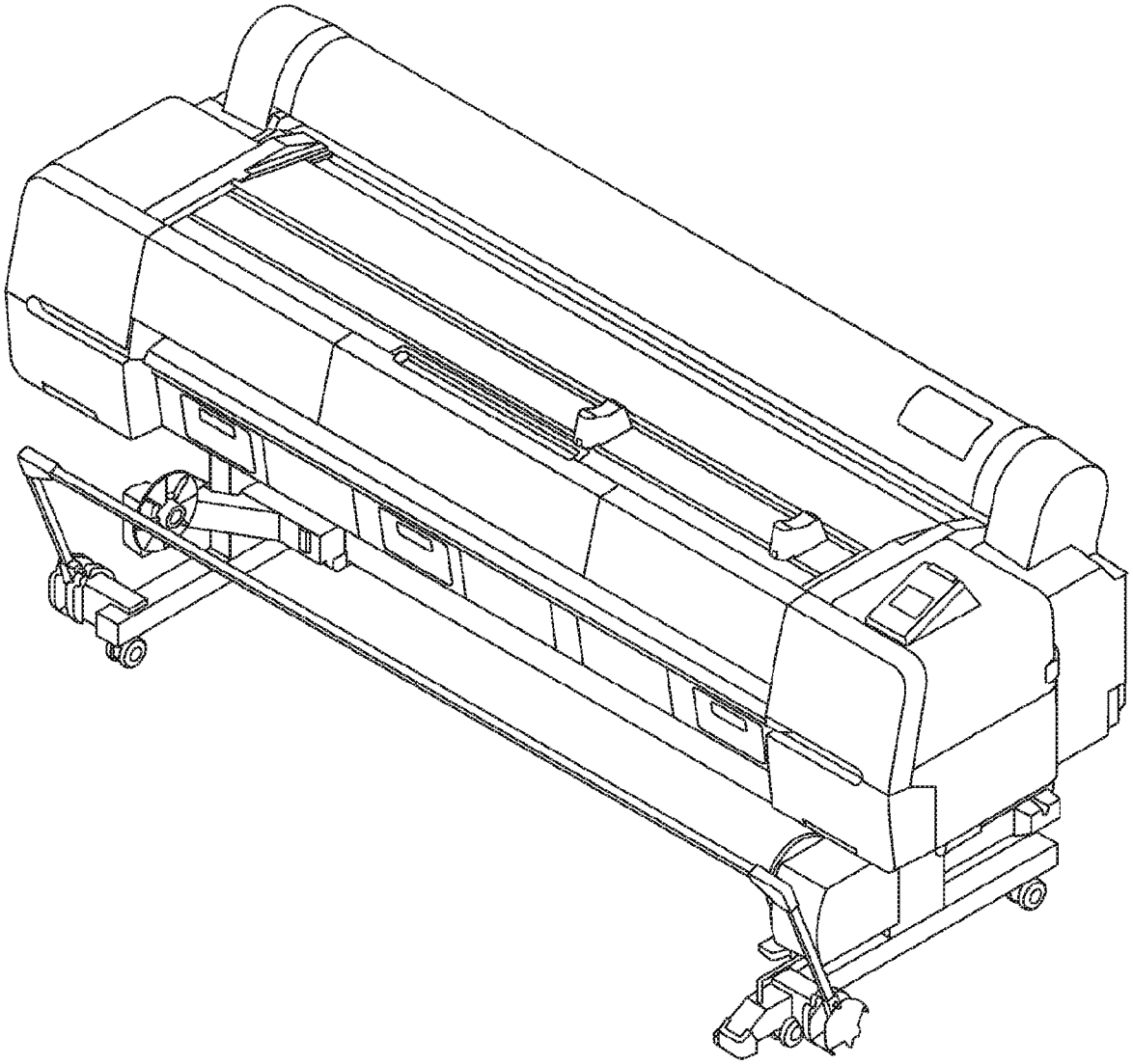
FIG. 10 is a first perspective view of a printer (without a printing medium).
Figure 11:
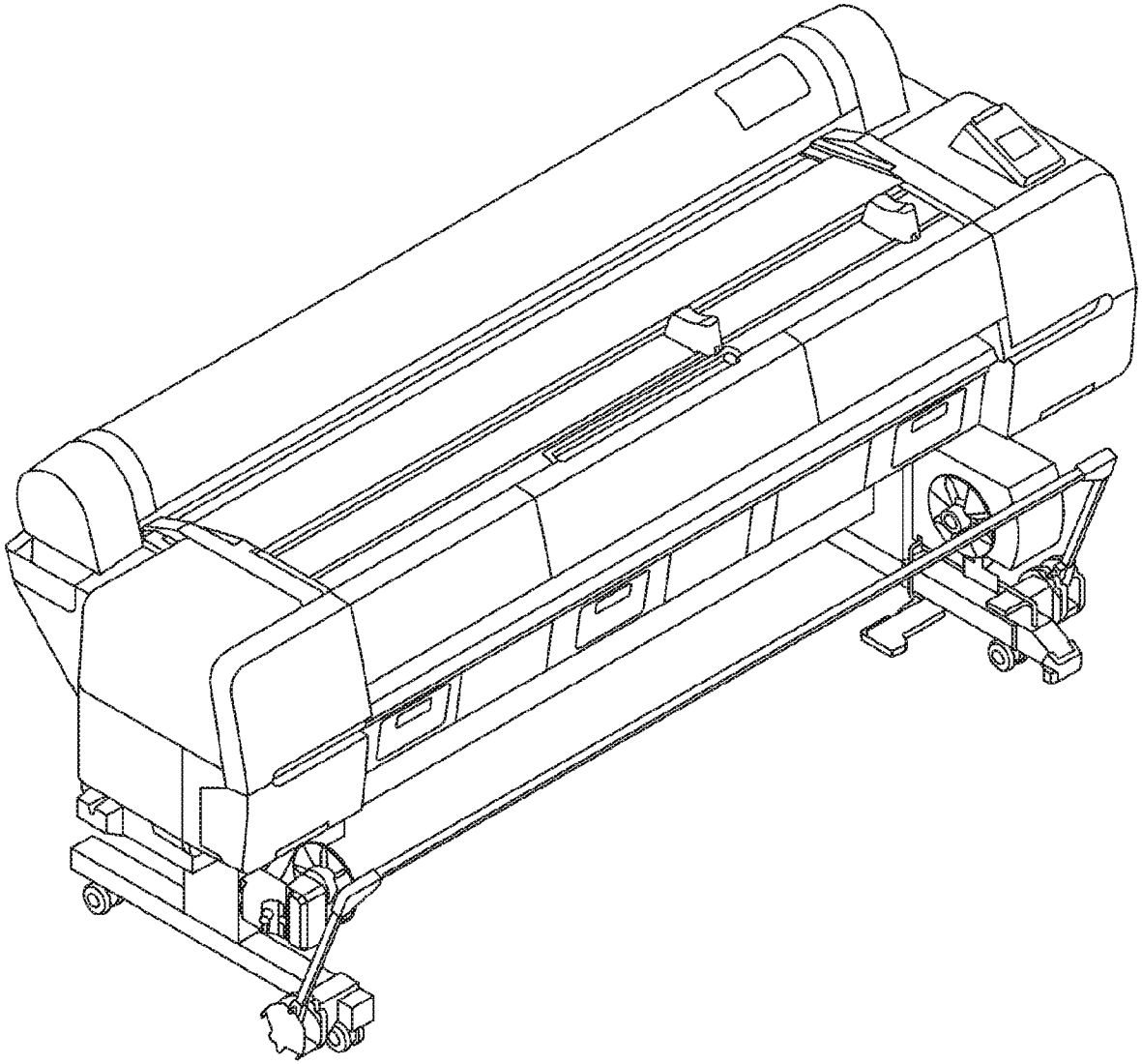
FIG. 11 is a second perspective view of a printer (without a printing medium).
Figure 12:
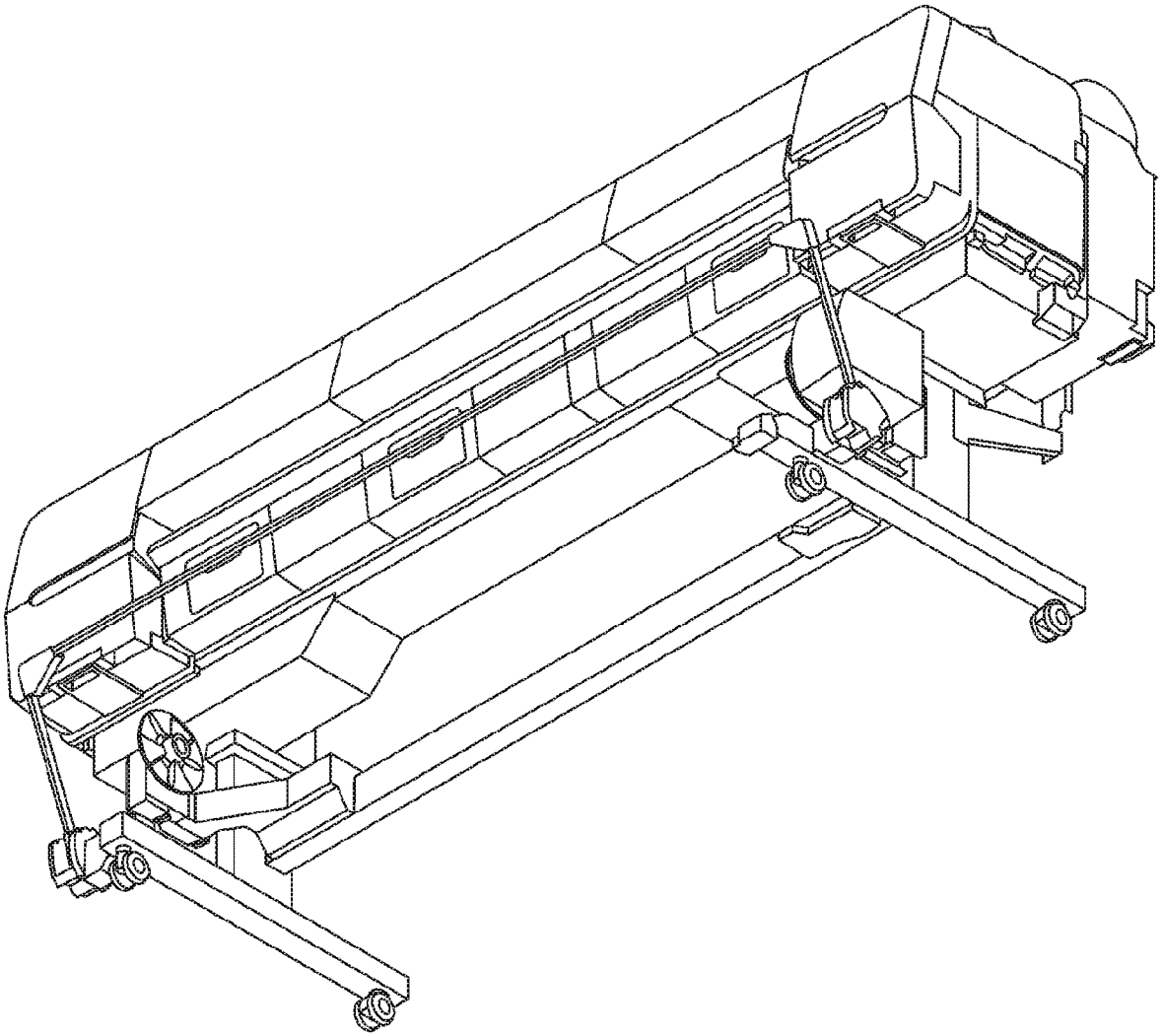
FIG. 12 is a third perspective view of a printer (without a printing medium).
Figure 13:
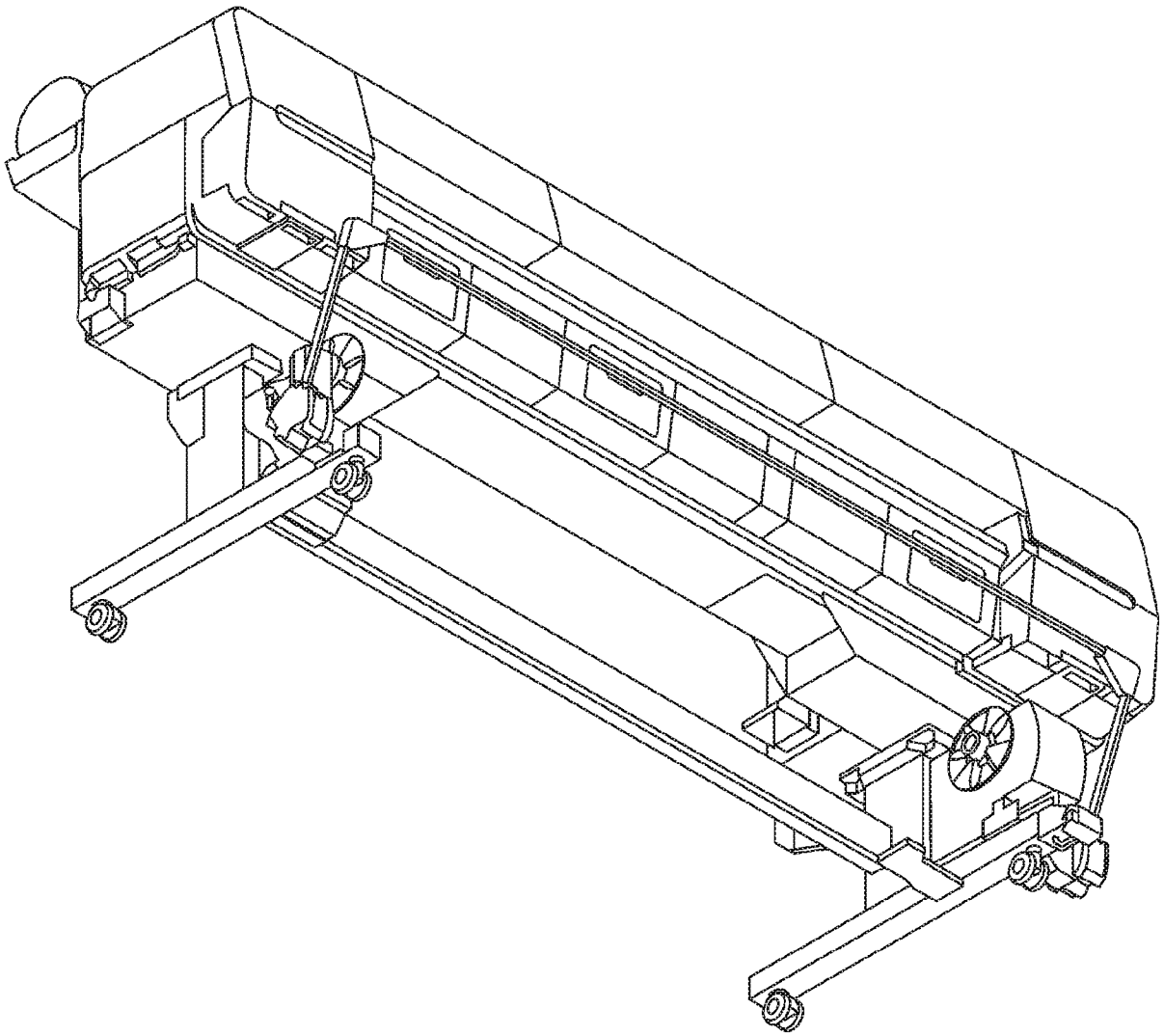
FIG. 13 is a fourth perspective view of a printer (without a printing medium).
Figure 14:
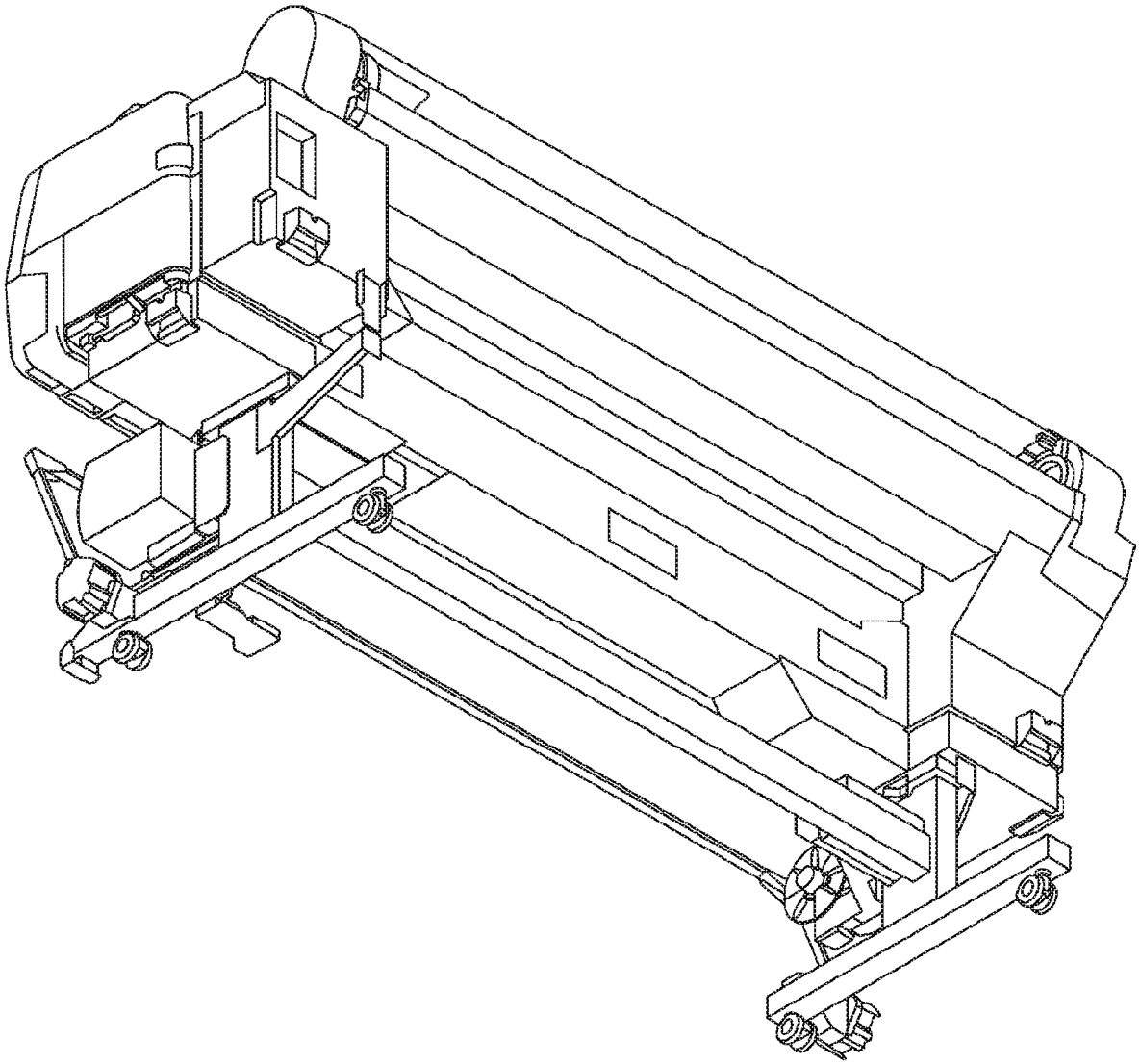
FIG. 14 is a fifth perspective view of a printer (without a printing medium).

Note that, as a reference, the printer 100 in a state where the printing medium P is not set is illustrated in FIG. 10 to FIG. 14. FIG. 10 is a first perspective view of when viewing the printer 100 from a first angle. FIG. 11 is a second perspective view of when viewing the printer 100 from a second angle. FIG. 12 is a third perspective view of when viewing the printer 100 from a third angle. FIG. 13 is a fourth perspective view of when viewing the printer 100 from a fourth angle. FIG. 14 is a fifth perspective view of when viewing the printer 100 from a fifth angle.

This application claims priority under 35 U.S.C. §119 to Japanese Patent Application No. 2015-205855, filed Oct. 19, 2015. The entire disclosure of Japanese Patent Application No. 2015-205855 is hereby incorporated herein by reference.

What is claimed is:

1. A printer comprising:

a printing unit that performs printing on a printing medium;

a winding unit that winds the printing medium on which the printing is performed by the printing unit; and a frame unit which is positioned between the printing unit and the winding unit on a feeding path of the printing medium, wherein in a case where the printing medium is not wound by the winding unit, a receiving member for receiving the printing medium is detachably mounted to the frame unit, and in a case where the printing medium is wound by the winding unit, the receiving member is detached such that the frame unit comes in contact with the printing medium.

2. The printer according to claim 1, wherein the winding unit comes in contact with the printing medium such that a part of the printing medium before being wound by the winding unit is curved to the side opposite to the winding unit.

3. The printer according to claim 1, wherein the frame unit includes an engaging portion which is engaged with the receiving member.

4. The printer according to claim 3, wherein a plurality of the engaging portions are provided along a width direction of the printing medium.

5. The printer according to claim 3, wherein the receiving member is attached to the frame unit so as to be wound, and wherein in the winding direction of the receiving member, the engaging portion is provided on the downstream side in the winding direction further than a position at a half circumference from a winding start position.

6. The printer according to claim 1, wherein a position where the frame unit is disposed in a case where the printing medium is not wound by the winding unit is the same as a position where the frame unit is disposed in a case where the printing medium is wound by the winding unit.

7. The printer according to claim 1, further comprising:

a detecting unit which is capable of detecting that a slack amount of the printing medium wound by the winding unit approaches a predetermined amount, wherein the detecting unit is capable of being displaced between a detecting position where the slack amount that approaches a predetermined amount is detected, and a retractable position which is retracted from the detecting position.

8. The printer according to claim 7, wherein the detecting unit includes a first detecting unit and a second detecting unit, and wherein at least one of the first detecting unit and the second detecting unit is rotated so as to be displaced between the detecting position and the retractable position.

9. The printer according to claim 7, wherein the detecting unit is detachable from the winding unit.

10. A method for using a printer that includes a printing unit that performs printing on a printing medium, a winding unit that winds the printing medium on which the printing is performed by the printing unit, and a frame unit which is positioned between the printing unit and the winding unit of a feeding path of the printing medium, the method comprising:

in a case where the printing medium is not wound by the winding unit, mounting a receiving member for receiving the printing medium to the frame unit; and in a case where the printing medium is wound by the winding unit, detaching the receiving member such that the frame unit comes in contact with the printing medium.

* * * * *